US009907153B2

(12) United States Patent
Abs et al.

(10) Patent No.: US 9,907,153 B2
(45) Date of Patent: Feb. 27, 2018

(54) COMPACT CYCLOTRON

(71) Applicant: Ion Beam Applications, S.A., Louvain-la-Neuve (BE)

(72) Inventors: Michel Abs, Bossière (BE); Sébastien De Neuter, Jandrenouille (BE)

(73) Assignee: Ion Beam Applications S.A., Louvain-la-Neuve (BE)

( * ) Notice: Subject to any disclaimer, the term of this patent is extended or adjusted under 35 U.S.C. 154(b) by 0 days.

(21) Appl. No.: 15/594,538

(22) Filed: May 12, 2017

(65) Prior Publication Data

US 2017/0332474 A1 Nov. 16, 2017

(30) Foreign Application Priority Data

May 13, 2016 (EP) ..... 16169489
May 13, 2016 (EP) ..... 16169490
May 13, 2016 (EP) ..... 16169494
May 13, 2016 (EP) ..... 16169497

(51) Int. Cl.
*H05H 13/10* (2006.01)
*H05H 7/04* (2006.01)
*H05H 13/00* (2006.01)

(52) U.S. Cl.
CPC ..... *H05H 7/04* (2013.01); *H05H 13/005* (2013.01)

(58) Field of Classification Search
CPC ..... H05H 13/00; H05H 13/005; H05H 13/06; H05H 13/10; H05H 11/00; H05H 11/02; H05H 15/00; H05H 7/04
USPC ..... 315/502, 200–501; 335/210
See application file for complete search history.

(56) References Cited

U.S. PATENT DOCUMENTS

2006/0255285 A1* 11/2006 Jongen ..... H05H 7/10 250/396 ML

FOREIGN PATENT DOCUMENTS

| | | |
|---|---|---|
| WO | WO 95/17802 A1 | 6/1995 |
| WO | WO 2004/049770 A1 | 6/2004 |
| WO | WO 2012/004225 A1 | 1/2012 |

OTHER PUBLICATIONS

European Search Report dated Nov. 3, 2016, 4 pages.
Nuttens et al., "Cyclotron Vacuum Model and H-Gas Stripping Losses," Proceedings of Cyclotrons 2010, Lanzhou, China, pp. 200-202.

* cited by examiner

*Primary Examiner* — Jimmy Vu
*Assistant Examiner* — Henry Luong
(74) *Attorney, Agent, or Firm* — Finnegan, Henderson, Farabow, Garrett & Dunner LLP

(57) ABSTRACT

The present disclosure relates to compact isochronous sector-focused cyclotrons having reduced dimensions and weight compared with state of the art cyclotrons of same energies. In one implementation, a cyclotron may include two pole magnets facing each other in a chamber defined by a yoke having base plates and flux return yokes forming a lateral wall of the chamber. The magnet poles may include between three and eight hill sectors alternating with a same number of valley sectors distributed about a central axis. The lip of the abyssal opening may be positioned at a distance from the corresponding valley peripheral edge. The flux return yoke may have a thickness in the portions facing valley sectors, such that the ratio of the product of the distance times the thickness to the square of the distance of the peripheral edge to the central axis is less than 5%.

20 Claims, 3 Drawing Sheets

COMPACT CYCLOTRON

This application claims the benefit of priority of European Patent Application No. 16169489.8, filed on May 13, 2016, European Patent Application No. 16169490.6, filed on May 13, 2016, European Patent Application No. 16169494.8, filed on May 13, 2016, and European Patent Application No. 16169497.1, filed on May 13, 2016, all of which are incorporated herein by reference.

TECHNICAL FIELD

The present disclosure relates to cyclotrons. In particular, it relates to compact isochronous sector-focused cyclotrons having reduced dimensions and weight compared with state of the art cyclotrons of same energies.

TECHNICAL BACKGROUND

A cyclotron is a type of circular particle accelerator in which negatively or positively charged particles are accelerated outwards from the centre of the cyclotron along a spiral path up to energies of several MeV. In isochronous cyclotrons, the particle beam runs each successive cycle or cycle fraction of the spiral path in the same time. Unless otherwise indicated, the term "cyclotron" is used in the following to refer to isochronous cyclotrons. Cyclotrons are used in various fields, for example in nuclear physics, in medical treatment such as proton therapy, or in radio pharmacology. In particular, cyclotrons can be used for producing short-lived positron-emitting isotopes suitable for PET (positron emitting tomography) and SPECT imaging (single photon emission computed tomography).

A cyclotron generally comprises several elements including an injection system, a radiofrequency (RF) accelerating system for accelerating the charged particles, a magnetic system for guiding the accelerated particles along a precise path, an extraction system for collecting the thus accelerated particles, and a vacuum system for creating and maintaining a vacuum in the cyclotron.

A particle beam is introduced into a gap at or near the center of the cyclotron by the injection system with a relatively low initial velocity. This particle beam is sequentially and repetitively accelerated by the RF accelerating system and guided outwards along a spiral path comprised within the gap by the magnetic field generated by the magnetic system. When the particle beam reaches its target energy, it is extracted from the cyclotron by the extraction system provided at a point of extraction. This extraction system can comprise, for example, a stripper consisting of a thin sheet of graphite. For example, ions passing through the stripper lose two electrons and become positive. Consequently, the curvature of their path in the magnetic field changes its sign, and the particle beam is thus led out of the cyclotron towards a target. Other extracting systems exist which are well known to the persons skilled in the art.

The magnetic system generates a magnetic field that guides and focuses the beam of charged particles along the spiral path until it is accelerated to its target energy (cf. FIGS. 4&5). In the following, the terms "particles", "charged particles", and "ions" are used indifferently as synonyms. The magnetic field is generated in the gap defined between two magnet poles by two solenoid coils wound around these poles. Magnet poles of cyclotrons are often divided into alternating hill sectors and valley sectors distributed around a central axis. The gap between two magnet poles is smaller at the hill sectors and larger at the valley sectors. A strong magnetic field is thus created in the gap within the hill sectors and a weaker magnetic field is created in the gap within the valley sectors. Such azimuthal magnetic field variations provide radial and vertical focusing of the particle beam. For this reason, such cyclotrons are sometimes referred to as sector-focusing cyclotrons. In some embodiments, a hill sector has a geometry of a circular sector similar to a slice of cake with a first and second lateral surfaces extending substantially radially towards the central axis, a generally curved peripheral surface, a central surface adjacent to the central axis, and an upper surface defining one side of the gap. The upper surface is delimited by a first and second lateral edges, a peripheral edge, and a central edge (cf. FIGS. 1(*b*) and 3).

In order to maintain a vacuum in the gap and to control and contain the magnetic field in the space surrounding the gap and pair of magnet poles, a cyclotron generally also comprises a yoke. A yoke is formed by a first and second base plates normal to the central axis, Z, which are separated from one another by a flux return yoke. The first and second base plates and flux return yoke define together a chamber, with the flux return yoke forming the outer walls of the cyclotron and controlling the magnetic field outside of the coils by containing it within the cyclotron. The first and second magnet poles are contained within the chamber. The first and second base plates are provided with openings for fluid communication of the chamber with vacuum pumps.

The flux return yoke is generally formed of two parts which are joined at the level of a median plane normal to the central axis, Z, so that the cyclotron can be opened by moving the first base plate and flux return yoke first part, together with the first magnet pole away from the second base plate, flux return yoke second part and second magnet pole. The flux return yoke must have a minimal thickness, Tv, in order to close and to contain within the cyclotron the magnetic field generated by the magnet poles outside the gap.

A cyclotron is typically a massive and voluminous piece of equipment weighing several tens of tons. This generally has an impact on the production cost as well as on the cost of transportation and handling of a cyclotron. Standard intermodal containers have a width of about 2.4 m and a similar height, with larger containers such as 40'- and 45'-high-cube containers, reaching a height of about 2.7 m. In order to fit in a standard intermodal container, a cyclotron must fit in a crate of less than 2.4 m (or 2.7 m). The dimensions of a low energy cyclotron, such as one suitable to accelerate 18 MeV protons, usually exceeds the size of standard intermodal containers, with a yoke of diameter of about 2 m and a hydraulic system positioned outside of the yoke. The high volume of cyclotrons requiring the use of non-standard containers together with the high weight of cyclotrons may have a negative impact on the cost and handling of cyclotrons.

There therefore remains a need in the art to provide an isochronous sector-focused cyclotron of both lower weight and lower dimensions, to reduce the costs of production and transportation and to enhance the ease of handling of such cyclotrons. Embodiments of the present disclosure may offer a solution for reducing considerably the volume and weight of cyclotrons.

SUMMARY

Embodiments of the present disclosure are defined in the appended independent claims. Further embodiments are defined in the dependent claims.

Embodiments of the present disclosure relate to a cyclotron for accelerating a particle beam over a given path comprised within a gap, said cyclotron comprising:

(a) A chamber defined within a yoke, wherein said yoke is formed by a first and second base plates normal to a central axis, Z, and separated from one another by a flux return yoke defining a lateral outer wall of the cyclotron, (b) first and second magnet poles located in the chamber and symmetrically positioned opposite to one another with respect to a median plane normal to the central axis, Z, and separated from one another by said gap, and wherein each of the first and second magnet poles comprises, (c) at least N=3 hill sectors having an upper surface (3U) and a same number of valley sectors comprising a bottom surface, said hill sectors and valley sectors being alternatively distributed around the central axis, Z, such that the gap separating the first and second magnet poles comprises hill gap portions defined between the upper surfaces of two opposite hill sectors and having an average gap height, Gh, measured along the central axis, Z, and valley gap portions defined between the bottom surfaces of two opposite valley sectors and having an average valley gap height, Gv, measured along the central axis, Z, with Gv>Gh;

(d) the bottom surfaces of each valley sector are defined by a valley peripheral edge, said valley peripheral edge being bounded by a first and a second lower distal ends, and is defined as the edge of the bottom surface located furthest from the central axis, Z;

(e) the bottom surfaces of each valley sector further comprise an abyssal opening extending through a thickness of the yoke base plates and defining an abyss gap portion of height, Ga, at least five times as large as Gh, said abyssal opening having a cross-section normal to the central axis defined by an abyss perimeter, which is separated from the valley peripheral edge by a shortest distance, Lap, measured along an abyss radial axis, Lar, intersecting perpendicularly the central axis, Z, and wherein the valley peripheral edge is separated from the central axis, Z, by a distance, Lv, measured along the abyss radial axis, Lar;

(f) the flux return yoke has a wall thickness varying with the angular position about the central axis, with a lowest wall thickness value, Tv, measured along the abyss radial axis, Lar, of each valley sector;

characterized in that, the ratio, $(Lap \times Tv)/Lv^2$, of the product of the distance, Lap, of the abyss perimeter to the valley peripheral edge of each valley sector times the flux return yoke thickness, Tv, to the square of the distance, Lv, of the peripheral edge to the central axis, Z, is less than 5%, for example, less than 3%, less than 2%, or less than 1%.

The size and position of the abyssal openings are important. In certain aspects, the ratio, 2Ra/Lv, of the diameter, 2Ra, of the abyssal opening to the distance, Lv, separating the valley peripheral edge (4*vp*) to the central axis, Z, measured along the abyss radial axis, Lra, may be between 45% and 60%, for example, between 48% and 55%. The ratio, 2Ra/La, of the diameter, 2Ra, of the abyssal opening to the distance, La, between the central axis, Z, and the centre of an abyssal opening cross-section may be at least 60%, for example, at least 65% or at least 70% of the value of La. The diameter, 2Ra, of the abyssal opening may be between 240 and 300 mm.

The thickness, Tv, of the flux return yoke facing a valley also depends on the average valley gap height and the size of the magnet pole. In particular, the ratio, $(Gv \times Tv)/Lv^2$, of the product, Gv×Tv, of the average valley gap height, Gv, times the flux return yoke thickness, Tv, to the square of the distance, Lv, of the peripheral edge to the central axis, Z, may be less than 20%, for example, less than 15% or less than 10%.

Because of the enhanced focusing effect attributed to the abyssal openings, shallower valleys than in state of the art cyclotrons may be used, which may be advantageous in terms of overall size and weight of the cyclotron. For example, the height ratio, Gh/Gv, of the average hill gap height, Gh, of the hill gap portions to the average valley gap height, Gv, of the valley gap portions may be between 8% and 20%. Concomitantly, with an enhanced focus of the particle beam, a narrower gap may then be implemented than hitherto applied. For example, the ratio of the height product, $(Gh \times Gv)/Lv^2$, of the average hill gap height, Gh, of the hill gap portions times the average valley gap height, Gv, of the valley gap portions to the square of the distance, Lv, of the peripheral edge to the central axis, Z, may be less than 5%, for example, less than 3% or less than 2%. The average hill gap height, Gh, of the hill gap portions may be between 20 and 27 mm, for example, between 22 and 26 mm. The average valley gap height, Gv, of the valley gap portions may be between 100 and 500 mm, for example, between 150 and 400 mm or between 200 and 250 mm Generally, broader valleys may be used, such that, for example, the first and second lower distal ends (3*lde*) of the valley peripheral edge (4*vp*) form with the central axis, Z, a valley azimuthal angle, αv, such that the ratio, Gh/tan (αv), of the average hill gap height, Gh, to the tangent of the valley azimuthal angle, tan (αv), is not larger than 30 mm, for example, not larger than 27 mm By way of further example, the valley azimuthal angle, αv, may be greater than 35°, for example, greater than 40° or greater than 42°, and may also be not more than 50°, for example, not more than 46° or not more than 45°

The flux return yoke may comprise an inner surface facing the chamber, and an outer surface facing away from the chamber and separated from the inner surface by the wall thickness of the flux return yoke. In embodiments having N=4 or 8 hill sectors and a same number of valley sectors, a cross-section normal to the central axis, Z, of the inner surface may have a circular geometry concentric with the central axis, Z, and a cross-section normal to the central axis, Z, of the outer surface may have a geometry inscribed in a square concentric with the central axis, Z, which edges are normal to the abyss radial axes, Lar, of four valley sectors, and which corners may be cut off.

It may be more cost effective if the base plates, magnet poles, and flux return yokes are all made of a same material and portions of the base plates and flux return yokes have a same height measured along the central axis, so that all major elements of the cyclotron structure can be made out of a same batch of material.

DESCRIPTION OF THE DRAWINGS

These and further aspects of the present disclosure will be explained in greater detail by way of example and with reference to the accompanying drawings in which.

DETAILED DESCRIPTION

The present disclosure relates to isochronous sector-focused cyclotrons, hereafter referred to as cyclotron of the type discussed in the technical background section supra. A cyclotron according to embodiments of the present disclosure accelerates charged particles outwards from a central area of the cyclotron along a spiral path 12 until they are extracted at energies of several MeV. For example, the charged particles thus extracted can be protons, $H^+$, or deuteron, $D^+$. In certain aspects, the energy reached by the extracted particles may be between 10 and 26 MeV, for example, between 15 and 21 MeV, or, by way of further example, 18 MeV. Cyclotrons of such energies are used, for example, for producing short-lived positron-emitting isotopes suitable for use in PET (positron emitting tomography) and SPECT imaging.

Figure 1:
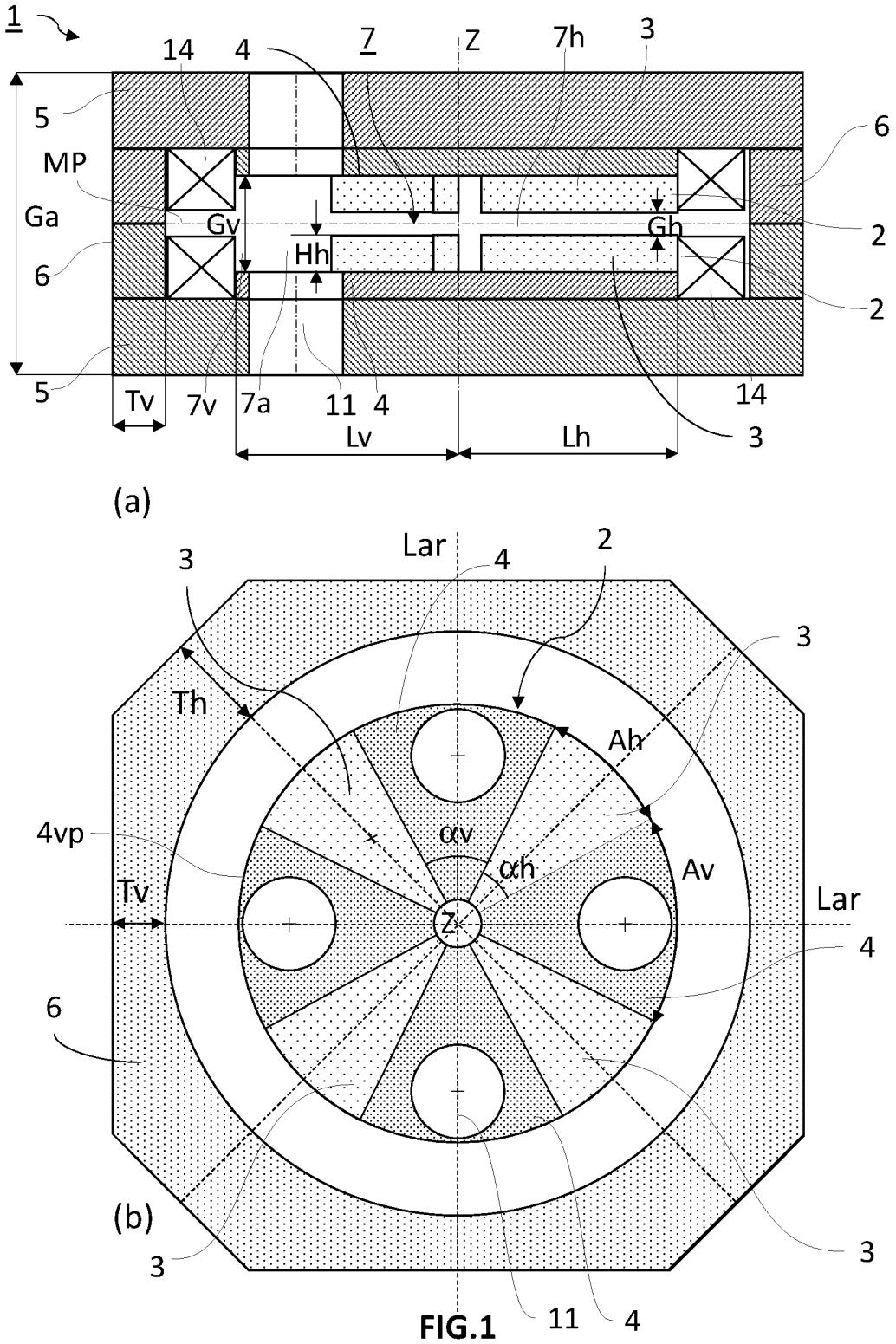
FIG. 1 schematically shows (a) a side cut view and (b) a top view of a cyclotron according to example embodiments of the present disclosure.
Figure 2:
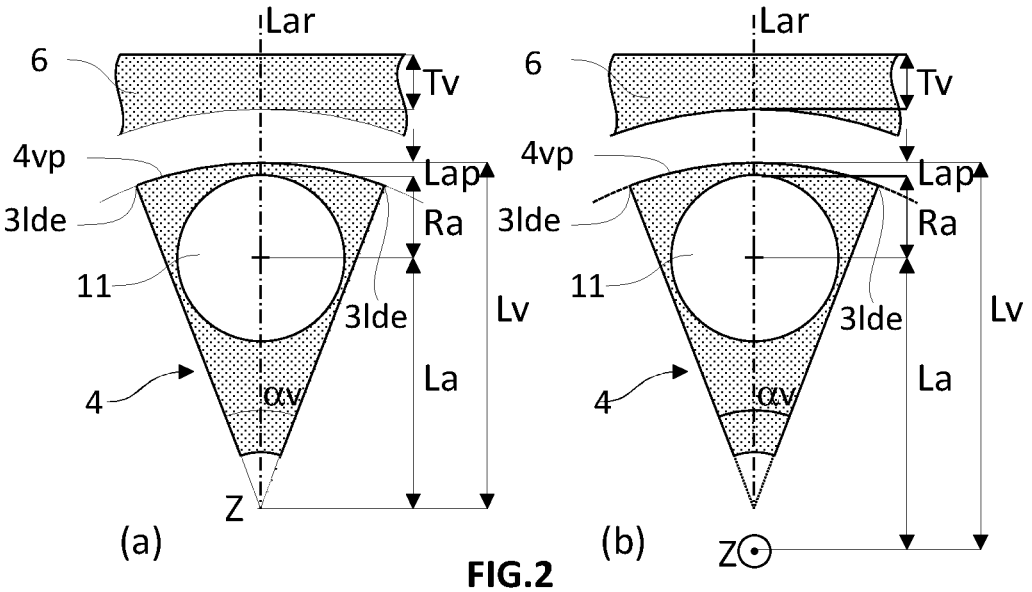
FIG. 2 shows a top view of a valley sector and a portion of the flux return yoke according to example embodiments of the present disclosure.

As illustrated in FIG. 1(*a*) a cyclotron 1 according to an embodiments of the present disclosure comprises a chamber defined by two base plates 5 and the flux return yokes 6 which, together, form a yoke. As illustrated in FIGS. 1(*a*) and 5, the flux return yokes form the outer walls of the cyclotron and control the magnetic field outside of the coils by containing it within the cyclotron. The containment of the magnetic field within the cyclotron determines the minimal thickness, Tv, of the flux return yokes 6, which depends on the intensity of the magnetic field outward of the gap 7.

A cyclotron may further comprises first and second magnet poles 2 located in the chamber, facing each other symmetrically with respect to a median plane MP normal to a central axis, Z, and separated from one another by a gap 7. The yoke and the magnet poles may be made of a magnetic material, for example, a low carbon (C) steel and form a part of the magnetic system. The magnetic system is completed by a first and second coils 14 made of an electrically conductive material wounded around the first and second magnet poles and fitting within an annular space of the chamber comprised between the magnet poles and the flux return yokes.

As illustrated in FIGS. 1(*b*) and 4, each of the first and second magnet poles 2 may comprise at least N=3 hill sectors 3 distributed radially around the central axis, Z (FIGS. 1(*b*) and 4 illustrate an embodiment with N=4). As illustrated in FIGS. 1(*b*) and 3, each hill sector 3 (represented in FIG. 1(*b*) as light shaded areas) has an upper surface 3U extending over a hill azimuthal angle, $\alpha h$. Each of the first and second magnet poles 2 may further comprise the same number, N, of valley sectors 4 distributed radially around the central axis Z (represented in FIG. 3 has dark shaded areas). Each valley sector 4 may be flanked by two hill sectors 3 and has a bottom surface 4B extending over a valley azimuthal angle, $\alpha v$, such that $\alpha h+\alpha v=360/N$. As illustrated in FIGS. 1(*b*) and 2, the bottom surfaces of the valley sectors may further comprise abyssal openings 11 which extend through the whole thickness of the yoke. Such openings may be required for fluidly connecting the chamber to a vacuum pump. As will be discussed further below, the presence of such openings may substantially reduce the overall dimensions and weight of cyclotrons.

Figure 4:
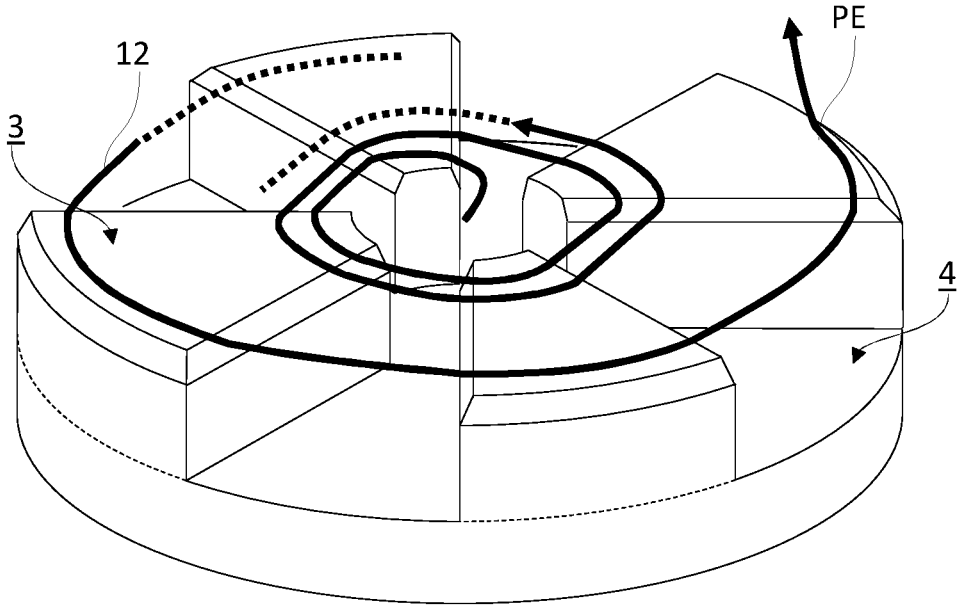
FIG. 4 shows a schematic view of a path followed by particles being accelerated from the central region of the magnet poles to the extraction point.

The hill sectors 3 and valley sectors 4 of the first magnet pole 2 face the opposite hill sectors 3 and valley sectors 4, respectively, of the second magnet pole 2. The path 12 followed by the particle beam illustrated in FIG. 4 is comprised within the gap 7 separating the first and second magnet poles. The gap 7 between the first and second magnet poles thus comprises:

- hill gap portions 7*h* defined between the upper surfaces 3U of two opposite hill sectors 3, and having an average gap height, Gh, defined as the average height of the hill gap portions over the areas of two opposite upper surfaces 3U,
- valley gap portions 7*v* defined between the bottom surfaces 4B of two opposite valley sectors 4 and having an average gap height, Gv, defined as the average height of the valley gap portions over the areas of two opposite bottom surfaces 4B, excluding the abyssal openings 11, and within the valley gap portions,
- abyss gap portions 7*a* defined between two opposite abyssal openings of a valley sector and having an average gap height, Ga, which is substantially larger than Gv and Gh.

Average hill and valley gap heights are measured as the average of the gap heights over the whole upper surface and lower surface of a hill sector and a valley sector, respectively. The average of the valley gap height ignores the abyssal openings on the bottom surfaces.

As illustrated in FIGS. 1(*b*) and 3, the upper surface 3U is defined by:

- an upper peripheral edge 3*up*, said upper peripheral edge being bounded by a first and a second upper distal ends 3*ude*, and being defined as the edge of the upper surface located furthest from the central axis Z;
- an upper central edge 3*uc*, said upper central edge being bounded by a first and a second upper proximal ends 3*upe* and being defined as the edge of the upper surface located closest from the central axis;
- a first upper lateral edge 3*ul* connecting the first upper distal end and first upper proximal end;
- a second upper lateral edge 3*ul* connecting the second upper distal end and second upper proximal end.

Note that, for sake of clarity, no extraction channel is shown at the upper edge of the flux return yokes 6 represented in FIGS. 1(*b*) and 3. It is clear that the flux return yokes of a cyclotron according to some embodiments of the present disclosure do comprise extraction channels allowing the particle beam to exit the cyclotron, as is well known to persons of ordinary skill in the art, and which need not be described more in detail here.

A hill sector 3 may further comprise (cf. FIG. 3):

- a first and second lateral surfaces 3L each extending transversally from the first and second upper lateral edges, to the bottom surfaces of the corresponding valley sectors located on either sides of a hill sector, thus defining a first and second lower lateral edges 3*ll* as the edges intersecting a lateral surface with an adjacent bottom surface, said first and second lower lateral edges each having a lower distal end 3*lde* located furthest from the central axis;
- a peripheral surface 3P extending from the upper peripheral edge to a lower peripheral line 31*p* defined as the segment bounded by the lower distal ends 3*lde* of the first and second lower lateral edges.

The average height, Hh, of a hill sector is the average distance measured parallel to the central axis between lower and upper lateral edges.

Similarly, a valley portion 4 is defined by a bottom surface 4B, flanked on either side by a lateral surface 3L of adjacent hill portions. The bottom surface of a valley portion is therefore bounded by the lower lateral edges 3*ll* of said adjacent lateral surfaces, and by a valley peripheral edge 4*vp* defined as the segment bounded by the lower distal ends 3*lde* of said lower lateral edges. The valley peripheral edge 4*vp* is defined as the edge of the bottom surface of a valley sector located furthest from the central axis Z.

The abyssal openings 11 are located in the valley portions, where they least disrupt the high magnetic field in the hill gap portions. As mentioned earlier, the abyssal openings are provided for fluidly communicating the chamber to a vacuum pump to ensure a sufficient level of vacuum in the chamber during use of the cyclotron. According to embodiments of the present disclosure, however, the abyssal openings may be given a further function of control of the magnetic field in the valley portions at the level of the outermost cycles of the particle beam path 12 (cf. FIG. 5). For this reason, the abyssal openings 11 may be located very close to the valley peripheral edge 4*vp* of each valley. The distance, Lap, of the abyss perimeter to the valley peripheral edge 4*vp* of each valley sector is defined as the shortest distance measured along an abyss radial axis, Lar, normal to and passing by the central axis, Z, between a perimeter of the abyss opening 11 and the valley peripheral edge 4*vp* of the corresponding valley sector. The abyss perimeter is defined as the perimeter of the cross-section of an abyssal opening over a plane normal to the central axis and including a lower distal end 3*lde* of an adjacent lateral surface 3L. If the bottom surface 4B is planar in the area surrounding an abyssal opening, the abyss perimeter may simply be the lip of the abyssal opening formed between the bottom surface and the opening.

An end of an edge is defined as one of the two extremities bounding a segment defining the edge. A proximal end is an end located closest to the central axis, Z. A distal end is an end located furthest from the central axis, Z. An end can be a corner point which is defined as a point where two or more lines meet. A corner point can also be defined as a point where the tangent of a curve changes sign or presents a discontinuity.

An edge is a line segment where two surfaces meet. An edge is bounded by two ends as defined supra and defines one side of each of the two meeting surfaces. For reasons of machining tools limitations, as well as for reduction of stress concentrations, two surfaces often meet with a given radius of curvature, R, which makes it difficult to define precisely the geometrical position of the edge intersecting both surfaces. In this case, the edge is defined as the geometric line intersecting the two surfaces extrapolated so as to intersect each other with and infinite curvature (1/R). An upper edge is an edge intersecting the upper surface 3U of a hill sector, and a lower edge is an edge intersecting the bottom surface 4B of a valley sector.

A peripheral edge is defined as the edge of a surface comprising the point located the furthest from the central axis, Z. If the furthest point is a corner point shared by two edges, the peripheral edge is also the edge of a surface which average distance to the central axis, Z, is the largest. For example, the upper peripheral edge is the edge of the upper surface comprising the point located the furthest to the central axis. If a hill sector is compared to a slice of tart, the peripheral edge would be the peripheral crust of the tart.

In an analogous manner, a central edge is defined as the edge of a surface comprising the point located the closest to the central axis, Z. For example, the upper central edge is the edge of the upper surface comprising the point located the closest to the central axis, Z.

A lateral edge is defined as the edge joining a proximal end of a central edge to a distal end of a peripheral edge. The proximal end of a lateral edge is therefore the end of said lateral edge intersecting a central edge, and the distal end of said lateral edge is the end of said lateral edge intersecting a peripheral edge.

Depending on the design of the cyclotron, the upper/lower central edges may have different geometries. The most common geometry is a concave line, often circular, of finite length ($\neq 0$), with respect to the central axis, Z, which is bounded by a first and second upper/lower proximal ends, separated from one another. This configuration may be useful as it clears space for the introduction into the gap of the particle beam. In a first alternative configuration, the first and second proximal central ends are merged into a single proximal central point, forming a summit of the upper surface 3U, which comprises three edges only, the central edge having a zero-length. If a hill sector is again compared to a slice of tart, the pointed tip of the slice would correspond to the central edge thus reduced to a single point. In a second alternative configuration, the transition from the first to the second lateral edges can be a curve convex with respect to the central axis, Z, leading to a smooth transition devoid of any corner point. In this configuration, the central edge is also reduced to a single point defined as the point wherein the tangent changes sign. Usually, even in the first and second alternative configurations, a hill sector does not extend all the way to the central axis, the area directly surrounding the central axis is cleared to allow insertion of the particle beam.

Figure 3:
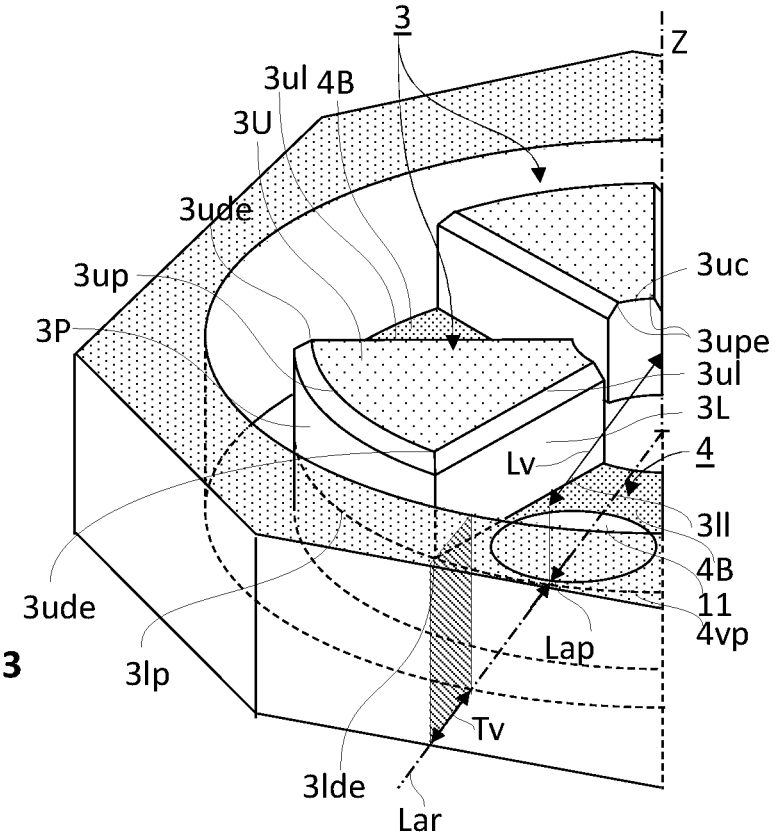
FIG. 3 shows a partial perspective view of a half cyclotron (the outlets for the extracted particles in the flux return yokes are not shown for enhancing visibility).

In some embodiments, as illustrated in FIG. 3, the first and second lateral surfaces 3L are chamfered forming a chamfer at the first and second upper lateral edges, respectively. A chamfer is defined as an intermediate surface between two surfaces obtained by cutting off the edge which would have been formed by the two surfaces absent a chamfer A chamfer may reduce the angle formed at an edge between two surfaces. Chamfers are often used in mechanics for reducing stress concentrations. In cyclotrons, however, a chamfered lateral surface at the level of the upper surface of a hill sector may enhance the focusing of the particle beam as it reaches a hill gap portion 7*h*.

As shown in FIG. 3, the peripheral surface 3P of a hill sector may also form a chamfer at the upper peripheral edge, which may improve the homogeneity of the magnetic field near the peripheral edge.

A cyclotron according to embodiments of the present disclosure may comprise N=3 to 8 hill sectors 3. For example, as illustrated in the Figures, N=4. For even values of N, the hill sectors 3 and valley sectors 4 must be distributed about the central axis with any symmetry of 2n, with n=1 to N/2. For example, according to a certain aspect, n=N/2, such that all the N hill sectors are identical to one another, and all the N valley sectors are identical to one another. For odd values of N, the hill sectors 3 and valley sectors 4 must be distributed about the central axis with symmetry of N. For example, according to a certain aspect, the N hill sectors 3 are uniformly distributed around the central axis for all N=3-8 (i.e., with a symmetry of N). The first and second magnet poles 2 are positioned with their respective upper surfaces 3U facing each other and symmetrically with respect to the median plane MP normal to the respective central axes Z of the first and second magnet poles 2, which are coaxial.

The shape of the hill sectors is often wedge shaped like a slice of tart (often, as discussed supra, with a missing tip) with the first and second lateral surfaces 3L converging from the peripheral surface towards the central axis Z (usually without reaching it). The hill azimuthal angle, ah, corresponds to the converging angle, measured at the level of the intersection point of the (extrapolated) upper lateral edges of the lateral surfaces at, or adjacent to, the central axis Z. The hill azimuthal angle, $\alpha h$, may be between 360°/2N±10°, for example, between 360°/2N±5° or between 360°/2N±2°.

The valley azimuthal angle $\alpha v$, measured at the level of the central axis Z may be between 360°/2N±10°, for example, between 360°/2N±5° or between 360°/2N±2°. The valley azimuthal angle $\alpha v$ may be equal to the hill azimuthal angle, $\alpha h$. In case of a degree of symmetry of N, $\alpha v=360/N-\alpha h$; for example, for N=4, $\alpha v$ is the complementary angle of $\alpha h$, with $\alpha v=90°-\alpha h$.

The largest distance, Lh, between the central axis and a peripheral edge strongly depends on the target energy the particles must reach before extraction and the intensity of the magnetic field. For example, in an 18 MeV proton cyclotron, the longest distance, Lh, is usually less than 750 mm, typically 520 to 550 mm. The upper peripheral edge has an azimuthal length, Ah, measured between the first and second upper peripheral ends, and can be approximated to, $Ah=Lh\times\alpha h$ [rad].

Figure 5:
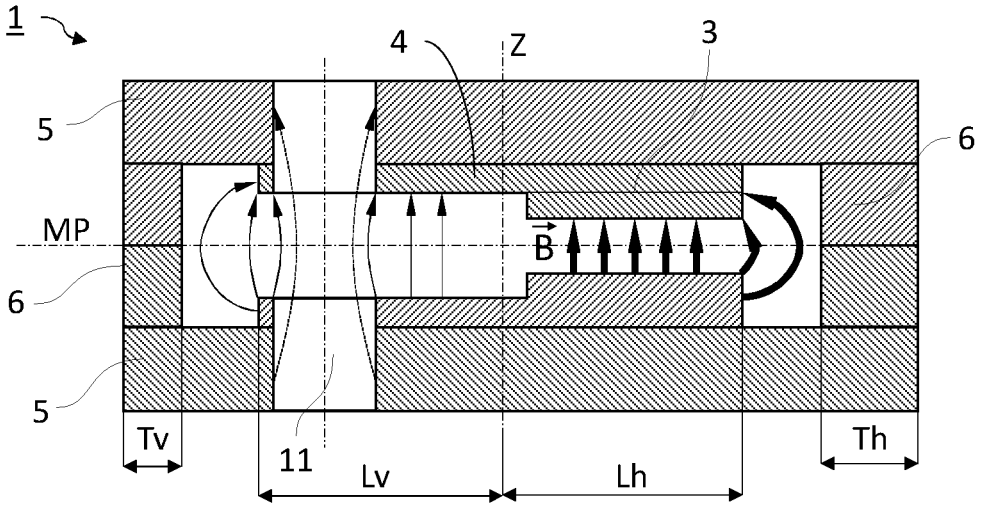
FIG. 5 shows schematically the shape and intensity of the magnetic field in and outside of a hill gap portion, valley gap portion, and abyss gap portion.

The two magnet poles and solenoid coils 14 wound around each magnet pole form an (electro-)magnet which generates a magnetic field in the gap between the magnetic poles that guides and focuses the beam of charged particles (=particle beam) along a spiral path 12 illustrated in FIGS. 4 and 5, starting from the central area of the cyclotron, until it reaches a target energy, for example, of 18 MeV. As discussed supra, the magnet poles are divided into alternating hill sectors and valley sectors distributed around the central axis, Z. As indicated in FIG. 5 with thick arrows, a strong magnetic field, B, is thus created in the hill gap portions 7*h* of height Gh within the hill sectors and a weaker magnetic field, indicated in FIG. 5 with thinner arrows, is created in the valley gap portions 7*v* of height Gv>Gh, within the valley sectors thus creating vertical focusing of the particle beam. The magnetic field in the abyssal gap portions 7*a* of height Ga>>Gv>Gh, between two abyssal openings 11 is yet weaker than in the valley gap portions 7*v*.

When a particle beam is introduced into a cyclotron, it is accelerated by an electric field created by so called dees (not shown), positioned in the valley sectors, where the magnetic field is weaker. Each time an accelerated particle penetrates into a hill gap portion 7*h* where the magnetic field is stronger with a higher speed as in the previous hill gap portion, it is deviated by the magnetic field forming an orbit path, substantially circular of radius larger than in the previous hill gap portion. Once a particle beam has been accelerated to its target energy, it may be extracted from the cyclotron at a point called point of extraction, PE, as shown in FIG. 4. For example, accelerated protons, $H^+$, may be extracted by driving a beam of accelerated $H^-$ ions through a stripper consisting of a thin sheet of graphite located at the point of extraction point, PE. A $H^-$ ion passing through the stripper loses two electrons to become a positive, $H^+$. By changing the sign of particle charge, the curvature of its path in the magnetic field changes sign, and the particle beam is thus led out of the cyclotron towards a target (not shown). Other extracting systems are known by the persons skilled in the art and the type and details of the extraction system used is not essential to some embodiments of the present disclosure. Usually, a point of extraction is located in a hill gap portion 7*h*. A cyclotron may comprise several points of extraction in a same hill portion. Because of the symmetry requirements of a cyclotron, more than one hill sector may comprise an extraction point. For degrees of symmetry of N, all N hill sectors comprise the same number of points of extraction. The points of extraction may be used either separately or two by two simultaneously.

The weight and size of a cyclotron according to embodiments of the present disclosure have been reduced by optimizing a number of dimensions, for example, by moving outwards the abyssal openings 11 close to the valley peripheral edges 4*vp* of the valley sectors, so as to decrease the intensity of the magnetic field at the periphery of the valley sectors of the magnet poles, where it normally is stronger than closer to the central axis, Z, and less uniform. In this example, the distance of an abyssal opening 11 to the valley peripheral edge 4*vp*, can be characterized by the shortest distance, Lap, measured along an abyss radial axis, Lar, intersecting perpendicularly the central axis, Z, between a periphery or lip of an abyssal opening 11 and the valley peripheral edge 4*vp*. The value of the shortest distance, Lap, in a cyclotron according to certain aspects may be less than 50 mm, for example, less than 30 mm or less than 20 mm. The abyssal opening should not be too close to the peripheral edge in order to not create singularities of the magnetic field at the valley peripheral edges which are difficult to control accurately. The value of Lap may therefore be at least 1 mm, for example, at least 5 mm.

A low value of the shortest distance, Lap, of an abyssal opening to the valley peripheral edge may substantially reduce the intensity of the magnetic field at the periphery and outwards of the magnet poles in the azimuthal regions facing the valley sectors. The thickness, Tv, of the flux return yokes facing the valley sectors measured along the abyss radial axis, Lar, may therefore be reduced accordingly. According to some embodiments of the present disclosure, the shortest distance, Lap, and thickness, Tv, of the flux return yokes facing the valley sectors are selected such that the ratio, $(Lap\times Tv)/Lv^2$, of the product of the distance, Lap, of the abyss perimeter to the valley peripheral edge of each valley sector times the flux return yoke thickness, Tv, to the square of the distance, Lv, of the peripheral edge to the central axis, Z, measured along the abyss radial axis, Lar, may be less than 5%, for example, less than 3%, less than 2%, or less than 1%. By comparison, a state of the art 18 MeV cyclotron may have a ratio, $(Lap\times Tv)/Lv^2$, of the order of 8% to 11%. A reduction of the thickness of the flux return yoke 6 facing the valley sectors may therefore yield a substantial reduction of weight and dimensions of the yoke.

A large abyssal opening 11 may also be advantageous. Abyssal openings usually have a circular cross-section of radius, Ra. If, as defined above, Lv is the distance between the central axis, Z, and the valley peripheral edge measured along the abyss radial axis, Lar, the diameter, 2Ra, of the abyssal opening may be between 45% and 60%, for example, between 48% and 55% of the value of Lv. In conventional cyclotrons wherein the abyssal openings merely serve for creating vacuum in the chamber, smaller diameters are generally used, of the order of about 40%. Compared with the distance, La, between the central axis, Z, and the centre of an abyssal opening cross-section. The abyss diameter, 2Ra, may be at least 60%, for example at least 65% or at least 70% of the value of La. For an 18 MeV cyclotron the abyss diameter, 2Ra, may be between 240 and 300 mm.

If the cross-section of an abyssal opening is not circular, the hydraulic radius, $R_{hyd}$, may be used instead of Ra, wherein $R_{hyd}$=4 A/P, wherein A and P are the area and perimeter of the abyssal opening cross-section, respectively.

Positioning the abyssal openings 11 close to the valley peripheral edge 4*vp* may also increase the focusing effect of the magnetic field on the particle beam as it enters into a hill gap portion 7*h* from an abyss gap portion 7*a*. The hill height, Hh, between a lower and higher lateral edges may therefore be reduced and, with a highly focused particle beam, the height of the hill gap portion may also be reduced. For example, the height ratio, Gh/Gv, (which is equal to Gh/(2Hh+Gh)) of the average hill gap height, Gh, of the hill gap portions to the average valley gap height, Gv, of the valley gap portions may be between 8% and 20%. In conventional deep valley cyclotrons, the Gh/Gv ratio may be of the order of not more than 5%, with a value of Hh which is considerably higher. All these elements may contribute to a substantial reduction of the size and weight of a cyclotron.

The average hill gap height, Gh, of the hill gap portions of a cyclotron according to some embodiments of the present disclosure may be between 20 and 27 mm, for example, between 22 and 26 mm. The average valley gap height, Gv, of the valley gap portions may be between 100 and 500 mm, for example, between 150 and 400 mm or between 200 and 250 mm. With a low value of Gv, the overall weight of the cyclotron may be reduced since, on the one hand, the hill sectors require less material and, on the other hand, the flux return yokes have a correspondingly low dimension measured parallel to the central axis, Z. Both Gh and Gv may have a low value compared with conventional sector-focusing cyclotrons. For example, the ratio, $(Gh\times Gv)/Lv^2$, of the height product, Gh×Gv, of the average hill gap height, Gh, of the hill gap portions times the average valley gap height, Gv, of the valley gap portions to the square of the distance, Lv, of the peripheral edge to the central axis, Z, may be less than 5%, for example, less than 3% or less than 2%. By contrast, a conventional sector-focusing cyclotron can have a ratio, $(Gh\times Gv)/Lv^2$, of the order of 6% to 8%.

Because of the presence of the abyssal openings 11 close to the valley peripheral edges, the thickness, Tv, of the flux return yoke measured along the abyss radial axis, Lar, (i.e. at a portion facing a valley sector) may be reduced in spite of the bottom surfaces 4B of two opposite valley sectors being separated by a low value of Gv. When a strong magnetic field is expected at the periphery of two magnet poles separated by a short distance, Gv, thus requiring a thick flux return yoke, a weak magnetic field only is created in a cyclotron according to some embodiments of the present disclosure because of the abyssal openings being located so close to the valley peripheral edges. For example, the ratio, $(Gv\times Tv)/Lv^2$, of the product, Gv×Tv, of the average valley gap height, Gv, times the flux return yoke thickness, Tv, to the square of the distance, Lv, of the peripheral edge to the central axis, Z, may be less than 20%, for example, less than 15% or less than 10%. Prior art sector-focusing cyclotrons generally have a $(Gv\times Tv)/Lv^2$ ratio greater than 40%, even of the order of 50%.

As illustrated in the Figures, in one embodiment, the first and second lower distal ends 3*lde* of the valley peripheral edge 4*vp* form with the central axis, Z, a valley azimuthal angle, αv, which, as discussed supra, is complementary to the hill azimuthal angle, αv, for N=4 hill sectors and valley sectors. For example, for N=4, the valley azimuthal angle, αv, may be between 35° and 50°, for example, between 40° and 46° or between 42° and 45° and, accordingly, the hill azimuthal angle, αh, may be between 55° and 40°, for example, between 50° and 44° or between 48° and 45°. By increasing the valley azimuthal angle, αv, the hill azimuthal angle, αh, may therefore be reduced and the weight of the cyclotron may be reduced accordingly. As discussed supra, on account of the high focusing effect of the abyssal openings 11, the hill gap portions may have a low value of the hill gap portion height, Gh. The combination of a large valley azimuthal angle, αv, and a low value of Gh can be characterized by a ratio, Gh/tan (αv), which may be not larger than 30 mm, for example, not larger than 27 mm. In a state of the art sector-focused cyclotron, the ratio, Gh/tan (αv), is generally higher and can be of the order of between 40 and 50 mm.

As illustrated in FIG. 1(*b*), in an embodiment of the present disclosure comprising N=4 or 8 hill sectors (for example, N=4 hill sectors), the flux return yoke 6 comprises an inner surface facing the chamber, and an outer surface facing away from the chamber and separated from the inner surface by the wall thickness of the flux return yoke. A cross-section normal to the central axis, Z, of the inner surface has a circular geometry concentric with the central axis, Z, and a cross-section normal to the central axis, Z, of the outer surface may have a geometry inscribed in a square concentric with the central axis, Z. The edges of the square may be normal to the abyss radial axes, Lar, of four valley sectors. This geometry may yield a smallest thickness of the flux return yoke, Tv, at the portions of the flux return yoke facing four valley sectors. The corners of the square may be cut off to accommodate the equipment (e.g., hydraulic, electric, or pneumatic) required for opening the cyclotron at the level of the median plane, MP, and thus may further reduce the outer dimensions of the cyclotron.

With a yoke having the geometry described supra, which is rendered possible by the lower magnetic field generated outwards of the valley sectors, cyclotrons of substantially lower dimensions and weight can be produced. For example, a 18 MeV compact cyclotron according to some embodiments of the present disclosure has been produced weighing about ⅓ less than a similar 18 MeV cyclotron of a former generation. Said compact cyclotron may be packed in a crate of dimensions fitting in a standard multimodal container, which was typically not possible with the cyclotron of the former generation, thus reducing substantially the costs and difficulties of transportation.

For a more cost effective production of a cyclotron yielding more uniform properties, the base plates 5, magnet poles 2, and flux return yokes 6 may be made of a same material. They may also be machined out of a single steel slab or of elements of a single steel slab (i.e., produced out of a single continuous casting operation). At least portions of the base plates 5 and flux return yokes 6 may have a same height measured along the central axis, Z.

The upper surface 3U of the hill sectors may be lower than an upper surface of the corresponding flux return yoke part, for example, offset by a distance Gh/2. If the magnet poles 2 rest on a planar base plate 5, then the height of the magnet poles may be equal to the height of the corresponding flux return yoke part minus Gh/2. Sometimes, however, the inner surfaces normal to the central axis of the first and second base plates, facing the chamber, may comprise a recess for accommodating the first and second magnet poles. In this case, the recess may be not deeper than Gh/2, so that magnet poles of same height as the flux return yokes can be used and so that the upper surfaces thereof can reach the required level.

In order to further facilitate the mounting and reproducibility of cyclotrons, each of the first and second magnet poles may be made of a single monobloc element comprising all the hill sectors and valley sectors machined out of said monobloc. This may allow the relative positions and heights of the hill and valley sectors to be accurately controlled numerically during machining, rather than relying on the manual positioning of each hill sector at their final location onto the corresponding base plates.

Cyclotrons according to embodiments of the present disclosure may be more compact and lighter than conventional cyclotrons. This is made possible by a number of optimizations, for example, by reducing the magnetic field being generated outwards of valley portions and by positioning the abyssal openings very close to the valley peripheral edges 4*vp*. Originally designed solely for fluidly communicating the chamber with a vacuum pump, the abyssal openings 11 have, in some embodiments of the present disclosure, a further function of, on the one hand, strongly focusing the particle beam as it penetrates into a hill gap portion 7*h* and, on the other hand, substantially reducing the intensity of the magnetic field generated outwards of the valley sectors. These two effects may allow:

The reduction of the thickness, Tv, of the flux return yokes facing the valley sectors, measured along the abyss radial axis, Lar, thus allowing a polygonal outer surface of the yoke, as illustrated in FIG. 1(*b*);

The reduction of the hill portion gap height, Gh, which yields a reduction of the height of the flux return yokes;

The reduction of the hill sector height, Hh, which also yields a reduction of the height of the flux return yokes.

All these elements may contribute to the substantial reduction in size and weight of a cyclotron. Examples have been given in the present specification for prior art and inventive cyclotrons of 18 MeV energy. It is clear that the same principles apply for the reduction of size and weight of cyclotrons of different energies.

| Ref # | Feature |
|---|---|
| 1 | Cyclotron |
| 2 | Magnet pole |
| 3 | Hill sector |
| 3U | Upper surface |
| 3up | Upper peripheral edge |
| 3ul | Upper lateral edge |
| 3uc | Upper central edge |
| 3ude | Upper distal end of upper lateral edge |
| 3upe | Upper proximal end of upper lateral edge |
| 3L | Lateral surface |
| 311 | Lower lateral edge |
| 31p | Lower peripheral line |
| 31de | Lower distal end of lower lateral edge and first and a second valley distal ends |
| 3P | Peripheral surface |
| 3ac | Arc of circle |
| H3 | Hill height |
| 3Plow | Lower portion of the peripheral surface |
| 3Pup | Upper portion of the peripheral surface |
| 3upc | Upper peripheral edge concave portion |
| 4 | Valley sector |
| 4B | Bottom surface |
| 4vp | valley peripheral edge |
| 5 | Yoke base plate |
| 6 | Flux return yoke |
| 7 | Gap |
| 7h | Hill gap portion |
| 7v | Valley gap portion |

-continued

| Ref # | Feature |
|---|---|
| 11 | Abyssal opening |
| 12 | Particles path |
| 14 | coil |
| αh | hill azimuthal angle [°] |
| αv | valley azimuthal angle [°] |
| dL | flux return yoke cut off length [mm] |
| Ga | mean gap height at abyss [mm] |
| Gh | mean gap height at hill [mm] |
| Gs | smallest gap height [mm] |
| Gv | gap height at valley [mm] |
| Hh | hill height [mm] |
| Ht | total height and gap height at abyss [mm] |
| Hv | Valley height [mm] |
| La | distance abyss centre to Z [mm] |
| Lap | distance of abyss to peripheral edge [mm] = Lv − (La + Ra) |
| Lar | abyss radial axis |
| Lc | distance pole to flux return yoke inner surface [mm] |
| Lh | radial distance of hill peripheral edge to Z [mm] |
| Lv | distance between Z and valley peripheral edge measured along Lra |
| Ra | Radius of abyss |
| Th | flux return yoke thickness at hill [mm] |
| Tv | flux return yoke thickness at valley [mm] |
| Z | Central axis |

The invention claimed is:

1. A cyclotron for accelerating a particle beam over a given path comprised within a gap, said cyclotron comprising:

a chamber defined within a yoke, wherein said yoke is formed by a first and second base plates normal to a central axis and separated from one another by a flux return yoke defining a lateral outer wall of the cyclotron; and first and second magnet poles located in the chamber and symmetrically positioned opposite to one another with respect to a median plane normal to the central axis and separated from one another by said gap, and wherein each of the first and second magnet poles comprises:

at least three hill sectors having an upper surface and a same number of valley sectors comprising a bottom surface, said hill sectors and valley sectors being alternatively distributed around the central axis such that the gap separating the first and second magnet poles comprises hill gap portions defined between the upper surfaces of two opposite hill sectors and having an average hill gap height measured along the central axis, and valley gap portions defined between the bottom surfaces of two opposite valley sectors and having an average valley gap height measured along the central axis, with the average valley gap height exceeding the average gap hill height, the bottom surfaces of each valley sector are defined by a valley peripheral edge, said valley peripheral edge being bounded by a first and a second lower distal ends and defined as the edge of the bottom surface located furthest from the central axis, the bottom surfaces of each valley sector further comprise an abyssal opening extending through a thickness of the yoke base plates and defining an abyss gap portion having a height at least five times as large as the average hill gap height, said abyssal opening having a cross-section normal to the central axis defined by an abyss perimeter, which is separated from the valley peripheral edge by a shortest distance measured along an abyss radial axis intersecting perpendicularly the central axis, and wherein the valley peripheral edge is separated from the central axis by a distance measured along the abyss radial axis, and the flux return yoke has a wall thickness varying with the angular position about the central axis, with a lowest wall thickness value measured along the abyss radial axis of each valley sector, wherein a ratio of the product of the shortest distance times the flux return yoke thickness to the square of the distance of the valley peripheral edge to the central axis is less than 5%.

2. The cyclotron according to claim 1, wherein the ratio is less than 3%.

3. The cyclotron according to claim 1, wherein a ratio of a diameter of the abyssal opening to the distance of the valley peripheral edge to the central axis is between 45% and 60%.

4. The cyclotron according to claim 1, wherein a ratio of a diameter of the abyssal opening to the distance between the central axis and a centre of an abyssal opening cross-section is at least 60%, and wherein the diameter between 240 and 300 mm.

5. The cyclotron according to claim 1, wherein a ratio of the product of the average valley gap height times the flux return yoke thickness to the square of the distance of the valley peripheral edge to the central axis is less than 20%.

6. The cyclotron according to claim 1, wherein a height ratio of the average hill gap height to the average valley gap height is between 8% and 20%.

7. The cyclotron according to claim 1, wherein a ratio of the product of the average hill gap height times the average valley gap height to the square of the distance of the valley peripheral edge to the central axis is less than 5%.

8. The cyclotron according to claim 1, wherein the average hill gap height is between 20 and 27 mm.

9. The cyclotron according to claim 1, wherein the average valley gap height is between 100 and 500 mm.

10. The cyclotron according to claim 1, wherein the first and second lower distal ends of the valley peripheral edge form, with the central axis, a valley azimuthal angle, such that a ratio of the average hill gap height to the tangent of the valley azimuthal angle is not larger than 30 mm.

11. The cyclotron according to claim 10, wherein the valley azimuthal angle is greater than 35°, and is also more not more than 50.

12. The cyclotron according to claim 1, further comprising four hill sectors and a same number of valley sectors, wherein the flux return yoke further comprises an inner surface facing the chamber, and an outer surface facing away from the chamber and separated from the inner surface by the wall thickness of the flux return yoke, wherein a cross-section of the inner surface normal to the central axis has a circular geometry concentric with the central axis, and wherein a cross-section of the outer surface normal to the central axis has a square geometry concentric with the central axis, whose edges are normal to the abyss radial axes of the four valley sectors, and whose corners are cut off.

13. The cyclotron according to claim 1, wherein the base plates, magnet poles, and flux return yokes are all made of a same material, and wherein portions of the base plates and flux return yokes have a same height measured along the central axis.

14. The cyclotron according to claim 1, wherein each of the first and second magnet poles is made of a single monobloc element comprising all the hill sectors and valley sectors thereof.

15. The cyclotron according to claim 1, further comprising eight hill sectors and a same number of valley sectors, wherein the flux return yoke further comprises an inner surface facing the chamber, and an outer surface facing away from the chamber and separated from the inner surface by the wall thickness of the flux return yoke, wherein a cross-section of the inner surface normal to the central axis has a circular geometry concentric with the central axis, and wherein a cross-section of the outer surface normal to the central axis has a square geometry concentric with the central axis, whose edges are normal to the abyss radial axes of the eight valley sectors, and whose corners are cut off.

16. The cyclotron according to claim 4, wherein the ratio of the diameter of the abyssal opening to the distance between the central axis and the centre of an abyssal opening cross-section is at least 70%.

17. The cyclotron according to claim 5, wherein the ratio of the product of the average valley gap height times the flux return yoke thickness to the square of the distance of the valley peripheral edge to the central axis is less than 10%.

18. The cyclotron according to claim 7, wherein the ratio of the product of the average hill gap height times the average valley gap height to the square of the distance of the valley peripheral edge to the central axis is less than 2%.

19. The cyclotron according to claim 9, wherein the average valley gap height is between 200 and 250 mm.

20. The cyclotron according to claim 11, wherein the valley azimuthal angle is greater than 42° and is also more not more than 45°.

* * * * *